US009326592B2

(12) United States Patent
Kim et al.

(10) Patent No.: US 9,326,592 B2
(45) Date of Patent: May 3, 2016

(54) TOOTHBRUSH HAVING INTERDENTAL BRUSH

(71) Applicants: Seong Yun Kim, Daegu (KR); Su Jin Kim, Daegu (KR)

(72) Inventors: Seong Yun Kim, Daegu (KR); Su Jin Kim, Daegu (KR)

( * ) Notice: Subject to any disclaimer, the term of this patent is extended or adjusted under 35 U.S.C. 154(b) by 106 days.

(21) Appl. No.: 14/306,528

(22) Filed: Jun. 17, 2014

(65) Prior Publication Data

US 2015/0089759 A1 Apr. 2, 2015

(30) Foreign Application Priority Data

Oct. 2, 2013 (KR) ..... 10-2013-0118055

(51) Int. Cl.
*A46B 9/06* (2006.01)
*A46B 9/04* (2006.01)
*A46B 15/00* (2006.01)

(52) U.S. Cl.
CPC ... *A46B 9/06* (2013.01); *A46B 9/04* (2013.01); *A46B 15/0069* (2013.01); *A46B 2200/108* (2013.01)

(58) Field of Classification Search
CPC ..... A46B 9/04; A46B 9/06
USPC ..... 15/167.1, DIG. 6; D4/104, 111
See application file for complete search history.

(56) References Cited

U.S. PATENT DOCUMENTS

| | | | | |
|---|---|---|---|---|
| 2,273,717 A * | 2/1942 | Millard | A46B 9/04 15/167.1 |
| 5,537,708 A * | 7/1996 | Luposello | A46B 9/04 15/160 |
| 5,930,860 A * | 8/1999 | Shipp | A46B 9/005 15/110 |
| 2003/0140442 A1 * | 7/2003 | Aoyama | A46B 9/005 15/167.1 |

* cited by examiner

*Primary Examiner* — Mark Spisich
(74) *Attorney, Agent, or Firm* — Rabin & Berdo, P.C.

(57) ABSTRACT

Disclosed is a toothbrush and a toothbrush having interdental brush. There is provided the configuration of the toothbrush in which toothbrush bristles are aligned in two lines without the bristles in the middle of toothbrush head, and interdental brush bristles are also provided, so that toothbrush bristles can be deeply fit into and touched to every teeth and interdental portions without needs of applying excessive power or pressure during toothbrushing, thereby to prevent damages on teeth and gums, easily remove food particles and plagues remained on the toothbrush, and prevent the secondary bacteria diseases due to fast dry of the toothbrush.

1 Claim, 3 Drawing Sheets

TOOTHBRUSH HAVING INTERDENTAL BRUSH

TECHNICAL FIELD

The present invention relates to the improvement of a toothbrush used to clean more effectively with easier brushing, reduce the gum recession and the abnormal tooth wear and keep toothbrush more sanitary by reforming the alignment of toothbrush bristles unlike conventional toothbrush.

BACKGROUND ART

The quality of a commercial typical toothbrush depends on the quality of toothbrush bristles. The toothbrush bristles have been developed and used in various types according to shapes or material quality. For example, synthetic resins are normally used as the material for the toothbrush bristles. The main reasons are its good moldability in manufacturing and cheap manufacturing costs.

In addition to good moldability, the toothbrush bristles must be as soft as not to damage teeth or gum, and must be hard enough in durability. At present, PBT (Poly Buthyle Telephthalate) is widely used as the material for toothbrush bristles, because PBT has softness close to artificial fur, good moldability, good hardness, and so on, many advantages suitable to be in use for toothbrush bristles.

However, the typical toothbrush is not as useful as to clean and remove food particles and dental plague off from teeth and interdental portions because of various reasons, firstly wrong usage habits of toothbrush (left-to-right direction) by a user, and clean only front surface of teeth, furthermore too much pressure applied on the teeth causing tooth wear or gum damage and disease. Therefore, typical toothbrush has many disadvantages.

Because of the problems as above, the way of using toothbrush bristles by rotary brushing that is, the way of brushing like move of making circles may be used by a user. In the rotary brushing usage, a user pushes and fits toothbrush bristles into between teeth and gum and pulls the toothbrush bristles down to up in rotary brushing way, by which a user can remove food particles and dental plague better without much power and pressure.

However, the above rotary brushing usage also has many problems as below. When toothbrush bristles are pushed and fit into between teeth and gum in order to remove interdental foreign substances, the removal of the interdental foreign substances such as food particles and dental plague is not easy because of the structural defects of typical toothbrush (repulsive force of toothbrush bristles positioned in the middle). So, a user has to apply too much power and pressure on teeth and gum when brushing with the toothbrush so as to make brushing much difficult and result the toothbrush bristles bent and widen easily, and thereby the toothbrush cannot be used as long as much.

Secondly, since excessive power more than necessary to remove interdental foreign substances is applied to teeth and gum, the interdental foreign substances can be removed, but the teeth and gum may be damaged.

Thirdly, the foreign substances taken off from teeth and fit into the toothbrush bristles cannot be removed completely even though washing the toothbrush cleanly, since the typical toothbrush bristles are provided on the surface of the toothbrush head very densely. Furthermore, the toothbrush is not dried well and cannot be kept in good condition so that bacteria is more easily produced causing infection in gum and various gum disease.

Fourthly, toothpaste more than necessary is put on toothbrush bristles and too much amount of toothpaste is used inside mouth since the toothbrush bristles are formed very densely, which is the problem of inefficient use and waste of toothpaste.

DISCLOSURE

Technical Problem

Therefore, the present invention has been made to solve the above problems, and it is an aspect of the present invention to provide an improved toothbrush being composed of a toothbrush head and toothbrush bristles in two lines on the toothbrush head, unlike a typical conventional toothbrush composed of toothbrush bristles normally aligned in four lines. The improved toothbrush according to the present invention prevents causing much pressure applied on teeth and gum during brushing by the structural configuration. In the typical one, teeth and gum were easily damaged because of the repulsive force of the toothbrush bristles on the middle of the toothbrush head during brushing. Further, the efficiency of toothbrush usage during brushing can be increased because the toothbrush bristles can be easily fit into the interdental portions between teeth. The substances from food remains inside mouth after brushing can be easily wiped off without fit into the toothbrush because of the two-aligned toothbrush bristles. The dry time for the toothbrush is shortened thereby suppress secondary infection by bacteria and keep the toothbrush in better sanitary condition.

Technical Solution

In accordance with the present invention, the above and other aspects can be accomplished by providing a toothbrush having interdental brush comprising: a handle 10 positioned at one end of the toothbrush; and a toothbrush head 20 positioned at the other end of the toothbrush and having bristles secured and projected toward one direction there from, in which a plurality of improved bristles 30 are provided projecting toward one direction from one surface of the toothbrush head 20 with a predetermined distance from each other and aligned in two lines around the periphery of the toothbrush head 20 to form a circular or oval shape and to provide an empty space part A in the middle of the toothbrush head 20.

Other purposes and advantages of the present invention will be more fully described below in reference with the embodiments of the present invention. The purposes and advantages of the present invention can be realized by the means of claims and the combinations thereof.

Advantageous Effects

As described above, in accordance with the present invention, a user can do brush one's teeth without needs of much power applied on teeth and gum and while feeling no repulsive force from the typical toothbrush bristles in the middle of the toothbrush head, thereby extending the life time of toothbrush bristles and decreasing the manufacturing costs.

In accordance with the present invention, a user can do brush one's teeth more effectively with a little power and much easily remove foreign substances and dental plagues off from the teeth and can use more effectively by the way of rotary brushing.

In accordance with the present invention, it is rare that foreign substances are remained on the toothbrush head and toothbrush bristles, thereby preventing the bacteria spread and problems of secondary infections.

In accordance with the present invention, the waste of toothpaste usages can be prevented and much amount of toothpaste applied on particular teeth portions can be reduced. The toothbrush of the present invention is very environment-friendly toothbrush greatly contributing to goods saving and environment protection.

Furthermore, the toothbrush of the present invention has simple configuration and is easy to manufacture.

DESCRIPTION OF DRAWINGS

These and other aspects and advantages of the present invention will become apparent and more readily appreciated from the following description of the embodiments, taken in conjunction with the accompanying drawings, in which.

Figure 1:
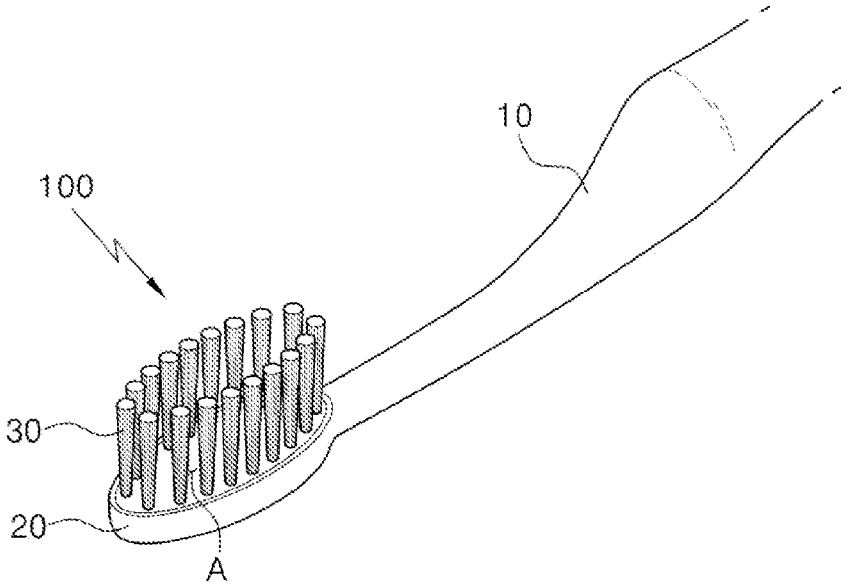
FIGS. 1 to 3 are views showing a toothbrush having interdental brush according to one embodiment of the present invention.

[Brief description of reference numbers of major elements]

| | |
|---|---|
| 10: handle | 20: toothbrush head |
| 30: improved bristles | 40: interdental bristles |
| 41: brush stem | 42: interdental brush fibers |
| A: empty space part | B: interdental brush part |

BEST MODE

The present invention to achieve the above aspects has the characteristics as follows:

In accordance with an embodiment of the present invention, there is provided a toothbrush having interdental brush comprising: a handle 10 positioned at one end of the toothbrush; a toothbrush head 20 positioned at the other end of the toothbrush and having bristles secured and projected toward one direction there from; and a plurality of improved bristles 30 projected from one surface of the toothbrush head 20 with a predetermined distance from each other and aligned in two lines around the periphery of the toothbrush head 20 to form a circular or oval shape and to provide an empty space part A in the middle of the toothbrush head 20.

In accordance with another embodiment of the present invention, among the improved bristles 30 projected and aligned in two lines, interdental bristles 40 are provided to form an interdental brush part B, and each of the interdental bristles 40 comprises a brush stem 41 vertically projected from one surface of the toothbrush head 20, and a plurality of interdental brush fibers 42 which are protruded from the entire circumferential surface of the brush stem 41, and extended in parallel with the surface of the toothbrush head 20.

Mode for Invention

The present invention will now be described more fully hereinafter with reference to the accompanying drawings, in which preferred embodiments of the invention are shown.

It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the invention, based on the principle that an inventor may properly define the meaning of the words or terms to best explain the invention.

As used herein, the singular forms "a", "an" and "the" are intended to include the plural forms as well, unless the context clearly indicates otherwise.

The present invention may be embodied in different forms and should not be construed as limited to the embodiments set forth herein. Rather, these embodiments are provided as teaching examples of the invention. Therefore, it will be understood that the scope of the invention is intended to include various modifications and alternative arrangements within the capabilities of persons skilled in the art using presently known or future technologies and equivalents.

Figure 2:
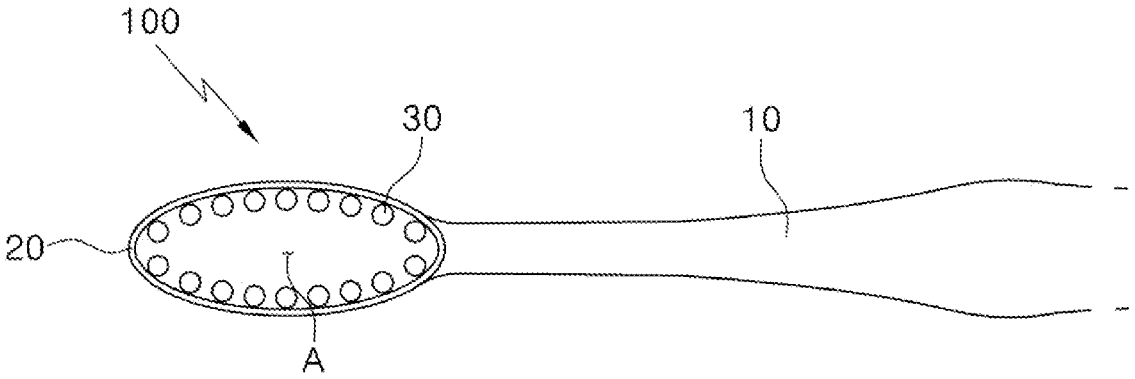
Figure 3:
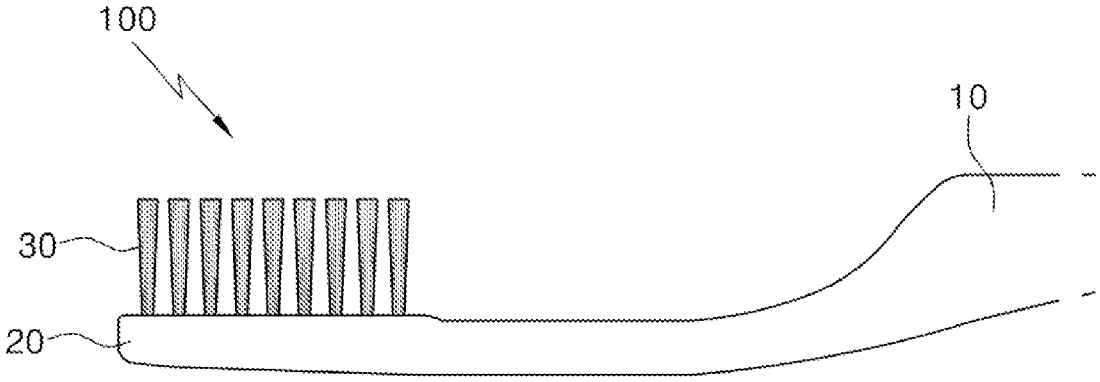
Figure 4:
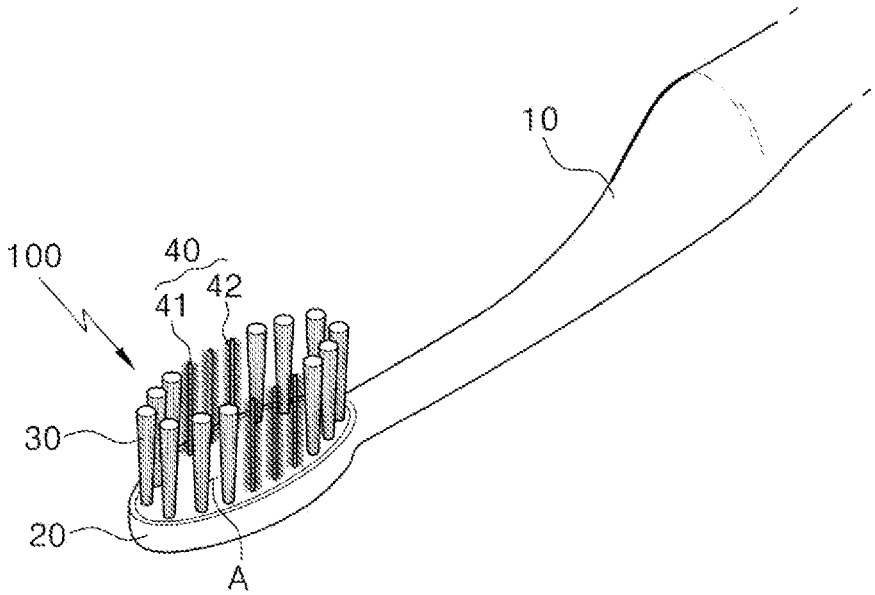
FIGS. 4 to 6 are views showing a toothbrush having interdental brush according to another embodiment of the present invention.
Figure 5:
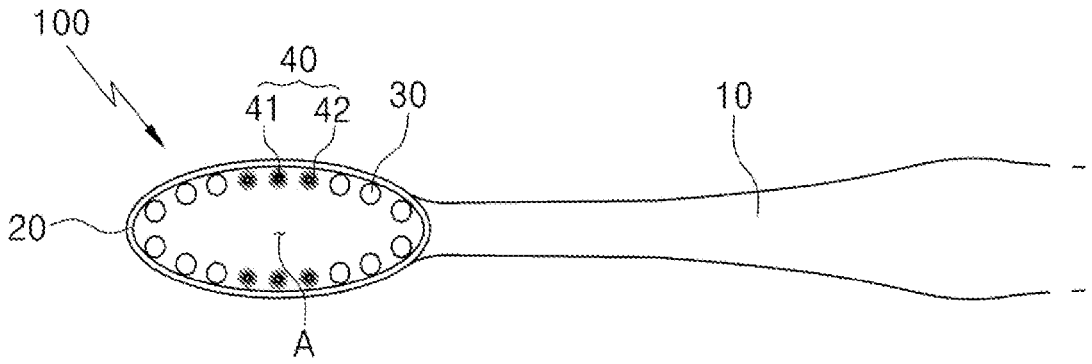
Figure 6:
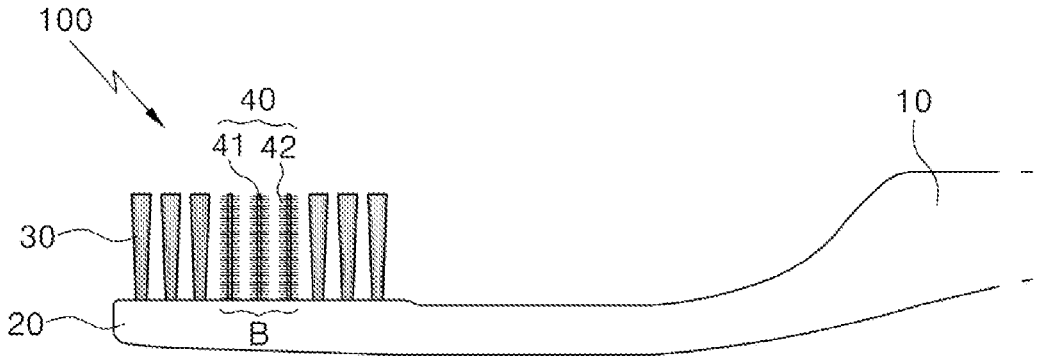

Hereinafter, referring to FIGS. 1 to 6, a toothbrush having an interdental brush according to embodiments of the present invention will be described.

As shown in the drawings, a toothbrush having an interdental brush 100 according to the present invention includes improved bristles 30 and interdental bristles 40.

Like a normal toothbrush typically used, the toothbrush according to the present invention is configured such that a handle 10 which a user is enable to hold is provided at one end of the toothbrush, and a toothbrush head 20 which a plurality of toothbrush bristles are formed on is provided at the other end of the toothbrush so that the bristles are directed toward one direction.

The improved bristles 30 correspond to the bristles as above, and the improved bristles 30 according to the present invention are provided on one side of the toothbrush head 20, projecting from one side of the toothbrush head 20, with a circle or oval shape along the circumference of the toothbrush head 20.

That is, the improved bristles 30 are aligned in two lines, with their both ends being connected to each other so that an empty space is formed in the middle of the toothbrush head 20 being surrounded by the improved bristles 30. The empty space forms an empty space part A.

Therefore, the bristles can be naturally and deeply fit into interdental portions or between teeth and gum without too much power or pressure on the toothbrush when cleaning teeth, so as to easily remove food particles and debris from the teeth and gums and easily remove plague on the teeth. In the normal teeth brush, much pressure on the toothbrush was required in order to remove interdental substances because the middle of the toothbrush head 20 was thickly filled with bristles by about two lines. Even with the much power and pressure in cleaning teeth with toothbrush as above, it was not effective to remove the particles or debris from the teeth and interdental portions rather caused damages on the teeth and gum because of the repulsive force of the two lines of bristles in the middle of the toothbrush. The improved bristles 30 according to the present invention does not cause such a problem.

Furthermore, since the toothbrush according to the present invention is composed of two lines of bristles, food particles or dental plague are less fit into the bristles or the toothbrush head 20 during or after brushing teeth with the toothbrush. Therefore, it takes less time to clean the toothbrush or dry the toothbrush so as to effectively restrain the growth or propagation of bacteria or germs on the toothbrush.

Of course, the improved bristles 30 in two lines according to the present invention may be formed with various shapes on the toothbrush head 20 such as 'T' shape as well as circle/oval shape according to various examples in use by a user.

The interdental bristles 40 are provided at the portions where the improved bristles 30 as above are located. A part of the improved bristles 30 in two lines are replaced with an interdental brush part B, and the interdental bristles 40 are provided in the interdental brush part B.

Since the interdental bristles 40 are aligned in two lines as above, the bristles can be deeply fit into the interdental portions and between teeth and gum during the use of the toothbrush and with no need of applying excessive power on the toothbrush, and food particles in the interdental portions and between the teeth and the gum can be clearly removed off.

Unlike the improved bristles 30 formed of a plurality of fine bristles or wipers and vertically projected relative to the toothbrush head 20, the interdental bristles 40 comprises a brush stem 41 vertically projected from the surface of the toothbrush head 20, and a plurality of interdental brush fibers 42 which are secured and protruded from the entire circumferential surface of the brush stem 41, and each bundle of the interdental brush fibers 42 is extended in parallel with the surface of the toothbrush head 20.

In particular, the interdental bristles 40 can be locally provided at any portion of a part of the improved bristles 30 formed of two lines according to various embodiment examples in use by a user. A user during the use of the toothbrush of the present invention can fit into and insert the portion of the toothbrush where the interdental bristles 40 are formed on between teeth or between teeth and gum where food particles are remained or plagues are formed so as to more cleanly remove the particles or plagues. Therefore, long use of the toothbrush of two lines of bristles according to the present invention provides effectiveness of less or little forming dental plagues on teeth.

Of course, as described above, the form and location of the interdental bristles 40 according to the present invention can be applied to any portions of two lines of the improved bristles 30 in various modifications according to various conditions such as the usage feature of a user (left-hander or right-hander), the teeth portion needing to be brushed and so one.

While the invention was described above with reference to the finite embodiments and drawings, the invention is not limited to the embodiments but can be modified and changed in various forms by those skilled in the art without departing from the technical concept of the invention and the equivalents of the appended claims.

What is claimed is:

1. A toothbrush having interdental brush comprising:

a handle positioned at one end of the toothbrush;

a toothbrush head positioned at the other end of the toothbrush;

a plurality of bristles projected from a first surface of the toothbrush head;

a plurality of interdental bristles projected from the first surface of the toothbrush head and including a brush stem vertically projected from the first surface of the toothbrush head, and a plurality of interdental brush fibers protruding from an entire circumferential surface of the brush stem and extending parallel with the first surface of the toothbrush head, wherein the plurality of bristles, together with the plurality of interdental bristles, are arranged with a predetermined distance from each other in two lines along both sides of the toothbrush head, such that the plurality of bristles together with the plurality of interdental bristles form a circular or oval shape as a whole on the toothbrush head and provide an empty space part in a middle of the toothbrush head, and wherein the plurality of interdental bristles are arranged in a middle portion of each of said two lines.

* * * * *